US007437899B1

(12) United States Patent
Ma

(10) Patent No.: US 7,437,899 B1
(45) Date of Patent: Oct. 21, 2008

(54) SUITCASE LOCK ASSEMBLY

(76) Inventor: Min-Tsung Ma, No. 299, Sec. 1, Park Rd., Chang Hua City, Chang Hua County 500 (TW)

( * ) Notice: Subject to any disclaimer, the term of this patent is extended or adjusted under 35 U.S.C. 154(b) by 0 days.

(21) Appl. No.: 11/833,795

(22) Filed: Aug. 3, 2007

(51) Int. Cl.
*E05B 65/52* (2006.01)

(52) U.S. Cl. ..... 70/69; 70/71; 70/74; 70/214; 70/284; 70/285; 70/298; 70/327; 292/36; 292/48

(58) Field of Classification Search ..... 70/214, 70/288, 315–318, 327, 328, 69–76, 21, 284, 70/285, DIG. 63, DIG. 71, 297–300, 313, 70/314, DIG. 22, DIG. 23, DIG. 75; 292/36, 292/48

See application file for complete search history.

(56) References Cited

U.S. PATENT DOCUMENTS 1,871,303 A * 8/1932 Chesick ..... 70/284
4,787,224 A * 11/1988 Mesa ..... 70/313
5,943,886 A * 8/1999 Chiang ..... 70/70
6,298,698 B1 * 10/2001 Nakajima et al. ..... 70/214
7,043,948 B1 * 5/2006 Wang ..... 70/214
7,266,980 B1 * 9/2007 Ma ..... 70/69
7,290,417 B1 * 11/2007 Huang ..... 70/285
7,318,331 B2 * 1/2008 Miao ..... 70/214
2004/0261477 A1 * 12/2004 Wang ..... 70/214
2005/0210937 A1 * 9/2005 Okuda ..... 70/214
2006/0162404 A1 * 7/2006 Hsieh ..... 70/71

* cited by examiner

*Primary Examiner*—Lloyd A Gall
(74) *Attorney, Agent, or Firm*—Browdy and Neimark, P.L.L.C.

(57) ABSTRACT

A suitcase lock assembly formed of a push-button lock and a pin tumbler lock for working with two locking units and two linking units in a suitcase, in which each push button of the push-button lock has two grooves for receiving a movable member to force a movable plate away from the linking units for allowing the linking units to be driven by the push blocks to open the locking covers, and the pin tumbler lock has an actuation block rotatable with the key to move the movable plate away from the linking units for allowing the linking units to be driven by the push blocks to open the locking covers. Thus, the user can selectively use the push-button lock or the pin tumbler lock, enhancing the security and convenience of use of the suitcase.

7 Claims, 7 Drawing Sheets

SUITCASE LOCK ASSEMBLY

BACKGROUND OF THE INVENTION

1. Field of the Invention

The present invention relates to locks and more particularly, to a suitcase lock assembly, which is the combination of a push-button lock and a pin tumbler lock.

2. Description of the Related Art

Conventional locks for suitcase include combination locks and pin tumbler locks. If a combination lock is used in a suitcase, the user must input a particular combination of numerals to open the suitcase. If a pin tumbler lock is used in a suitcase, the user must insert a matching key into the keyway of the pin tumbler lock and then rotate the plug of the pin tumbler lock with the key to the unlocking position to open the suitcase.

If a combination lock is used in a suitcase and the suitcase user forgets the correct combination of numerals, the user will fail to open the suitcase. Under the circumstances, the user must deliver the device to the seller or a locksmith to open the combination lock so that the user can take the items out of the suitcase. Further, a malicious person may decrypt the combination of a combination lock easily and steal the items stored in the suitcase. If a pin tumbler lock is used in a suitcase and the suitcase user does not have the matching key in hand, the user will still fail to open the suitcase.

SUMMARY OF THE INVENTION

The present invention has been accomplished under the circumstances in view. It is the main object of the present invention to provide a suitcase lock assembly, which is the combination of a push-button lock and a pin tumbler lock, allowing the user to open the suitcase by means of the push-button lock or the pin tumbler lock optionally.

It is another object of the present invention to provide a suitcase lock assembly whose push-button lock provides a complicated combination to ensure high security and allows the user to change the preset combination as desired.

To achieve the foregoing objects of the present invention, the suitcase lock assembly is comprised of a base casing, a lock housing having a plurality of wells, a movable plate pivotally mounted in the lock housing for movement relative to the lock housing between a first position and a second position, a push-button lock mounted in the lock housing, a pin tumbler lock mounted in the lock housing for rotation between a locking position and an unlocking position, two locking units, and two linking units movably mounted in the base casing corresponding to the locking units. The push-button lock includes a plurality of push buttons for upward and downward movement in the lock housing, a plurality of spring members, a sliding member, and a return device. The push buttons each have a first groove and a second groove located below the first groove. The spring members are sleeved onto the push buttons respectively and mounted in the wells inside the lock housing. The sliding member is movable forwards and backwards in the lock housing, having a plurality of wings and a stop end. At least one of the wings of the sliding member is engaged into the first groove of at least one of the push buttons and the other wings are respectively engaged into the second grooves of the push buttons and the stop end of the sliding member is stopped against the movable plate when the push-button is unlocked. The wings of the sliding member are disengaged from the first and second grooves of the push buttons and the stop end of the sliding member is separated from the movable plate when the push-button lock is unlocked. The return device is movably mounted inside the lock housing and connected to the sliding member. The pin tumbler lock includes an actuating block, which is stopped against the movable plate when the pin tumbler lock is located at the unlocking position, or separated from the movable plate when the pin tumbler lock is located at the locking position. The locking units each include a holder frame mounted in the base casing, a locking cover pivoted to the holder frame, a push block mounted in the locking cover, and a spring member connected between the locking cover and the push block. The locking cover has a retaining rod for engagement with a hook in a suitcase in which the suitcase lock assembly is installed. The linking units each include a first link, which has a first end and a second end, a spring member connected between the first end of the first link and the holder frame of the corresponding locking unit, a second link, which has a first end and a second end, the first end of said second link being coupled to the second end of the first link, and a third link, which has a first end coupled to the second end of the second link and a second end thereof for stopping against the movable plate. When the movable plate is located at the second position, the second ends of the third links of the linking units are stopped against the movable plate, the push blocks are prohibited from moving the linking units, and the locking covers of the locking units are prohibited from pivoting movement relative to the corresponding holder frames. When the movable plate is located at the first position, the second ends of the third links of the linking units are free from the constraint of the movable plate, the push blocks are movable to move the linking units, and the locking covers of the locking units are pivotable relative to the corresponding holder frames.

By means of the above-mentioned arrangement, the invention allows the user to open the suitcase by means of the push-button lock or the pin tumbler lock optionally, enhancing convenience of use for the user. Further, the user can conveniently change the set combination of the push-button lock when intended, enhancing the security of the suitcase.

DETAILED DESCRIPTION OF THE INVENTION

Figure 1:
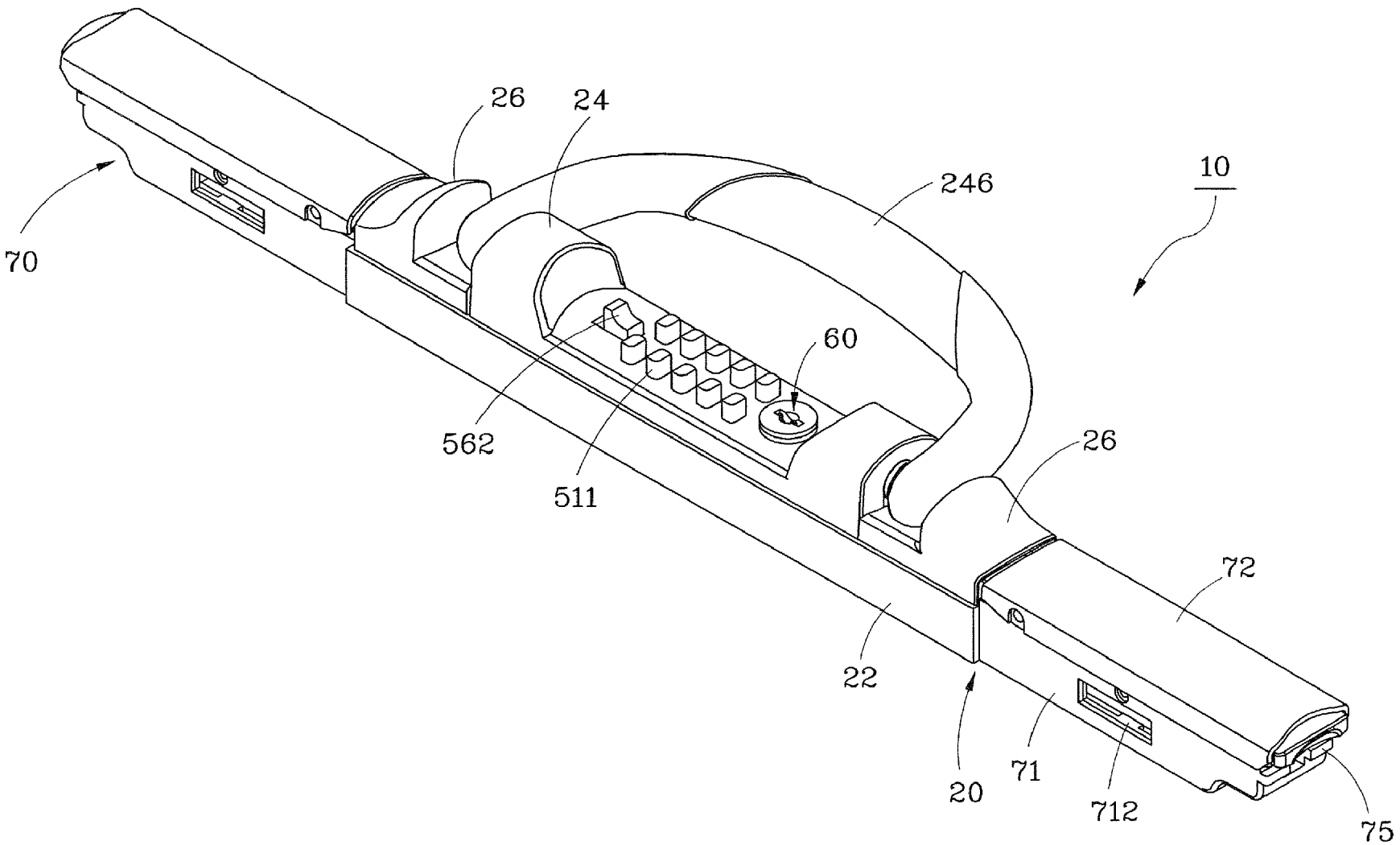
FIG. 1 is a perspective view of a suitcase lock assembly according to the present invention.
Figure 3:
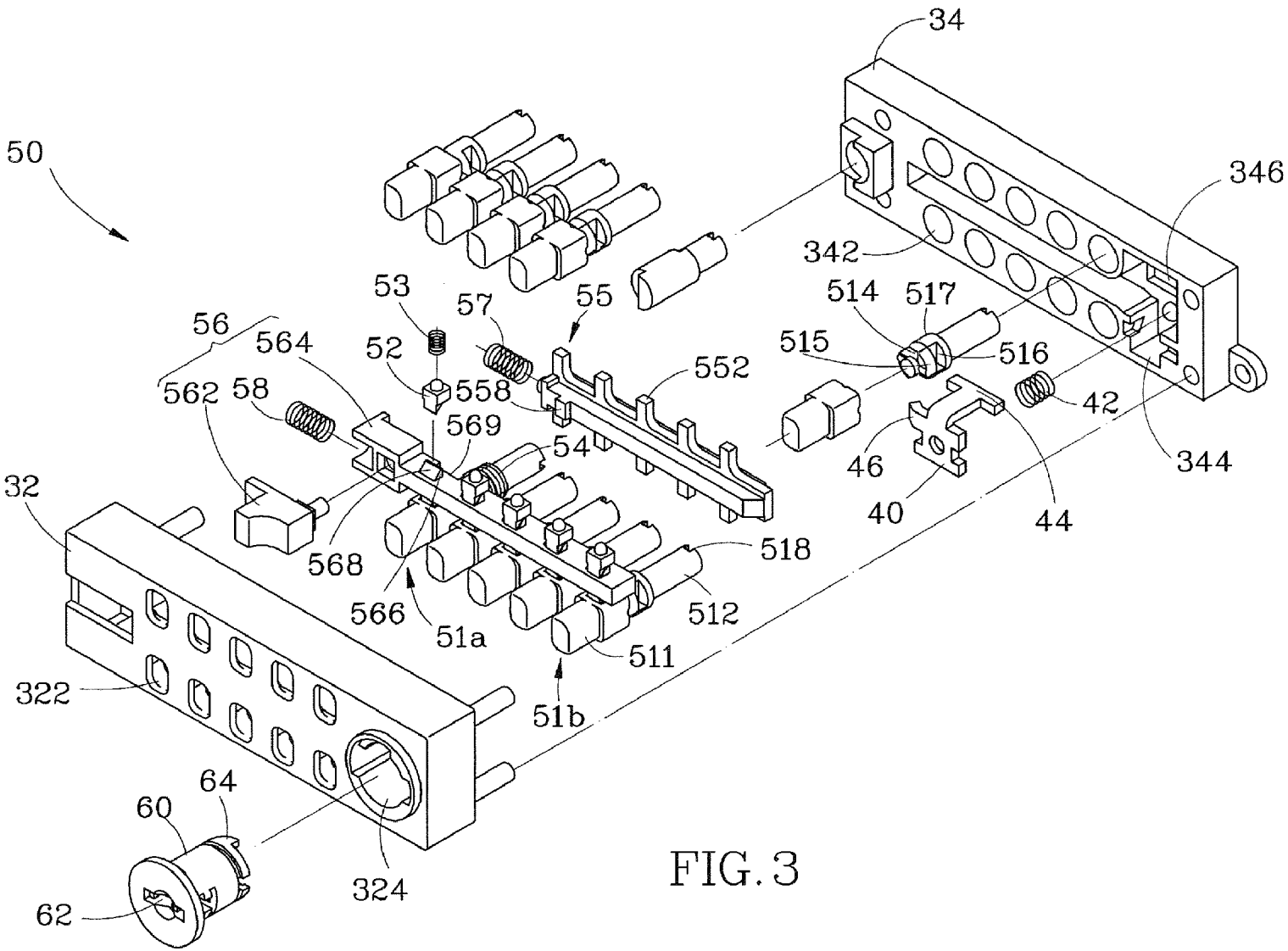
FIG. 3 is an exploded view of the push-button lock of the suitcase lock assembly according to the present invention.
Figure 8:
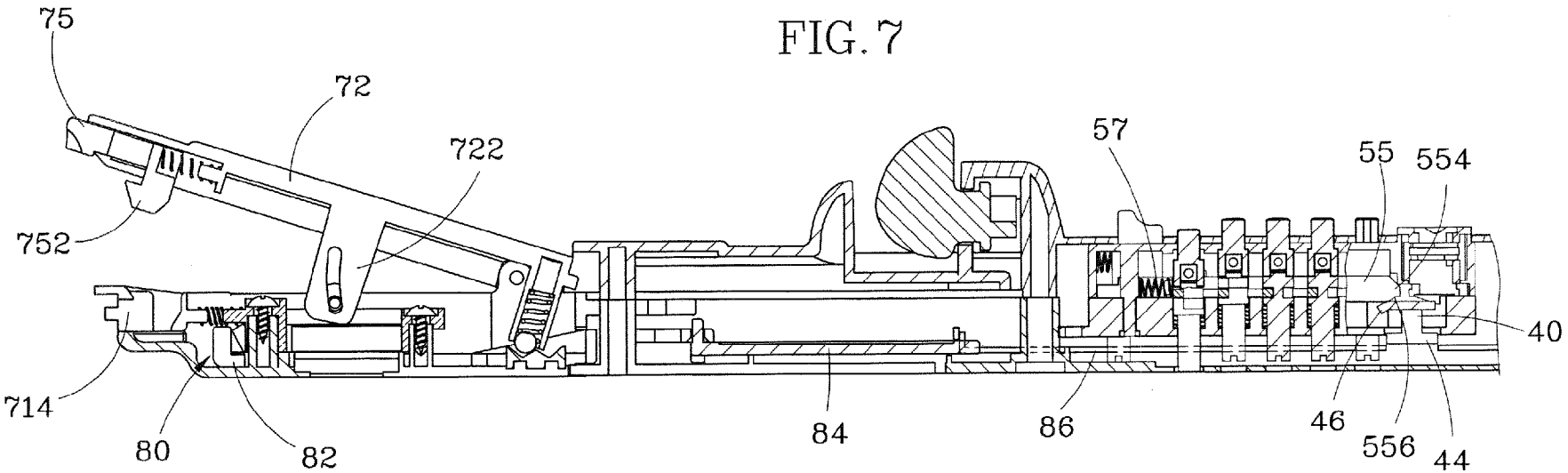
FIG. 8 is a sectional view of a part of the present invention, showing that the push-button lock is unlocked.

Referring to FIGS. 1, 3, and 8, a suitcase lock assembly 10 in accordance with the present invention is comprised of a base casing 20, a lock housing 30, a movable plate 40, a push-button lock 50, a pin tumbler lock 60, two locking units 70, and two linking units 80.

Figure 2:
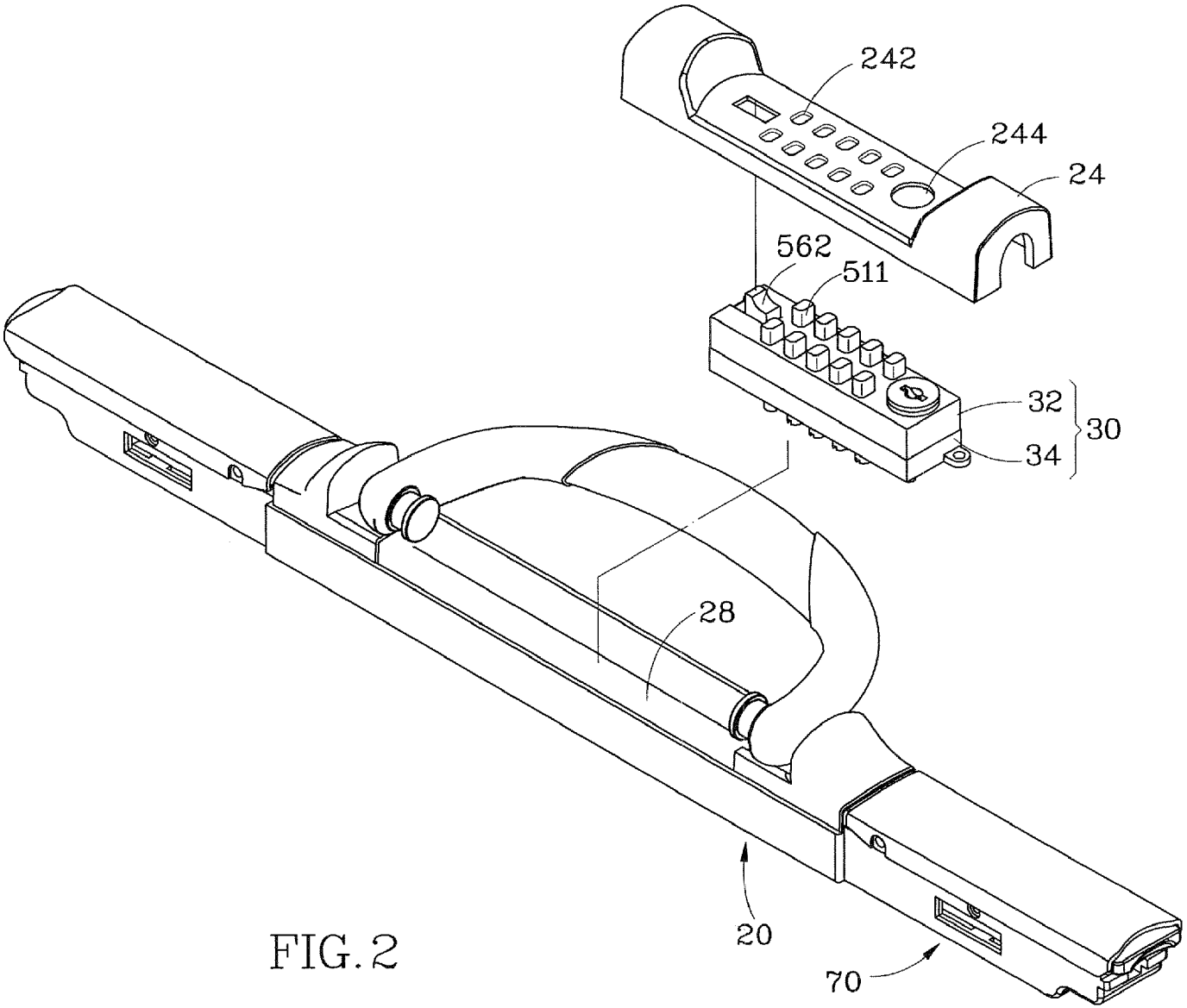
FIG. 2 is a partially exploded view of the suitcase lock assembly according to the present invention.

Referring to FIGS. 1 and 2 again, the base casing 20 includes an elongated bottom shell 22, a top cover 24, and two side covers 26. The top cover 24 is located at a top side of the bottom shell 22. The side covers 26 are located at the top cover 24 bilaterally, abutting two opposite sides of the top cover 24 respectively. Thus, the top cover 24, the side covers 26, and the bottom shell 22 define an accommodation chamber 28 in the base casing 20. The top cover 24 has ten first holes 242 and a second hole 244. Further, a handle 246 is pivoted to the top cover 24 for holding by a user's hand for carrying the suitcase.

The lock housing 30 is mounted in the accommodation chamber 28 of the base casing 20, including a top cover shell 32 and a bottom cover shell 34. The top cover shell 32 and the bottom cover shell 34 are abutted together. The top cover shell 32 has ten button holes 322 corresponding to the first holes 242, and a keyhole 324 corresponding to the second hole 244. The bottom cover shell 34 has ten wells 342 corresponding to the button holes 322, a recession 344 corresponding to the keyhole 324, and an elongated slot 346 in communication with the recession 344.

The movable plate 40 is pivotally mounted to the recession 344 of the bottom cover shell 34 and is resiliently forced by a first spring member 42 to move between a first position and a second position. The movable plate 40 has a stop flange 44 and an extension portion 46. The stop flange 44 extends through the elongated slot 346 out of the bottom cover shell 34.

Figure 5:
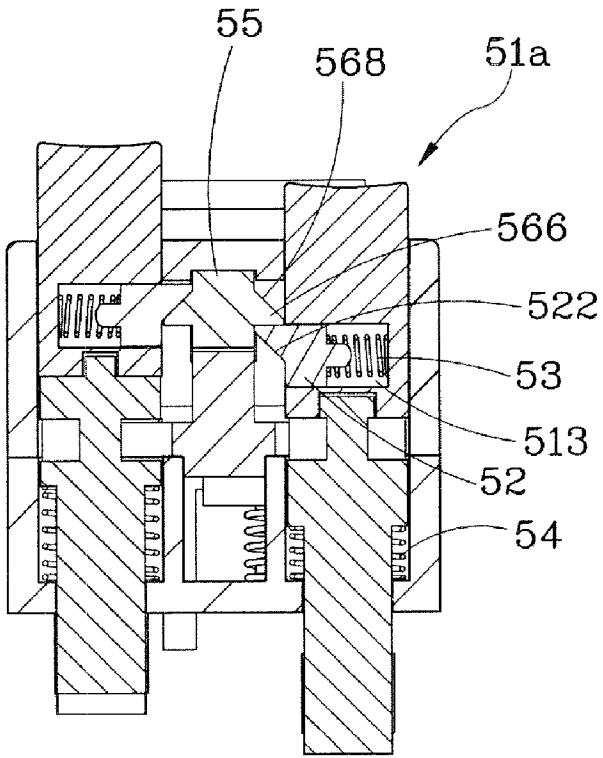
FIG. 5 is a sectional view taken along a line 5-5 of FIG. 4.
Figure 4:
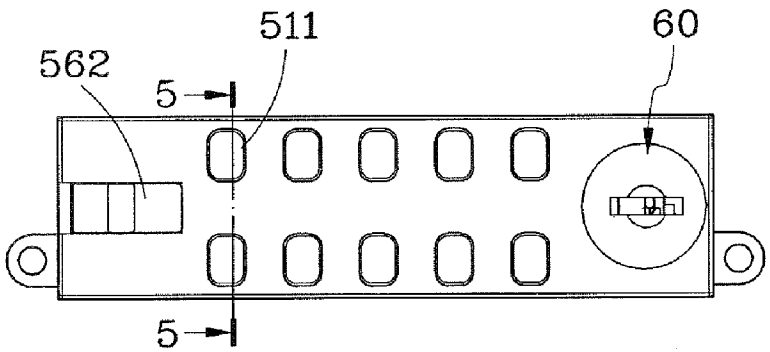
FIG. 4 is a top view of the push-button lock of the suitcase lock assembly according to the present invention.

Referring to FIGS. 4 and 5, the push-button lock 50 is mounted in the lock housing 30, including ten push buttons 51*a* and 51*b*, a plurality of positioning members 52, a plurality of second spring members 53, a plurality of third spring members 54, a movable member 55, and a return device 56. The push buttons 51*a* and 51*b* each have a head 511 and a body 512. The head 511 has a groove 513, as shown in FIG. 5. The heads 511 of the push buttons 51*a* and 51*b* respectively pass through the button holes 322 of the top cover shell 32 and the first holes 242 of the top cover 24 to expose themselves outside the base casing 20 for convenient pressing by the user to move the respective push buttons 51*a* and 51*b* in vertical direction relative to the lock housing 30. The bodies 512 each have a top end stopped against a bottom end of the corresponding head 511 and each have a bottom end received in the corresponding well 342 of the bottom cover shell 34 for free rotation therein. The bodies 512 of the buttons 51*a* and 51*b* each have two first grooves 514, two first stop portions 515, two second grooves 516, and two second stop portions 517. The first grooves 514 and the first stop portions 515 are disposed above the second grooves 516 and the second stop portions 517. The first grooves 514 and the first stop portions 515 are alternately arranged. The second grooves 516 and the second stop portions 517 are alternately arranged. The first grooves 514 and the second grooves 516 are alternately arranged. Further, each of the bodies 512 has a bottom tool groove 518 for receiving a tool and then the user can drive the tools to rotate the respective bodies 512. The positioning members 52 are located in the respective heads 511, each have a sloping surface 522. The second spring members 53 are respectively mounted in the grooves 513 of the heads 511 of the push buttons 51*a* and 51*b* and respectively stopped against the positioning members 52, generating resilience for pushing the positioning members 52 outward. The third spring members 54 are respectively sleeved onto the bodies 512 of the push buttons 51*a* and 51*b* and mounted in the wells 342 of the bottom cover shell 34 to generate resilience for pushing the push buttons 51*a* and 51*b* upward. The movable member 55 is disposed above the bottom cover shell 34 and pushed toward the movable plate 40 by a fourth spring member 57. The movable member 55 has five side wings 552 horizontally extending from each of the two opposite lateral sides thereof respectively. Following vertical movement of the push buttons 51*a* and 51*b*, the side wings 552 are moved to engage into the first grooves 514 or the second grooves 516, or to be stopped by the first stop portions 515 or second stop portion 517. Further, the movable member 55 has a front stop end 554 and a sloping surface 556 formed at the front stop end 554, as shown in FIG. 8, for stopping against the movable plate 40 to move the movable plate 40 from the first position to the second position. A protruding portion 558 is provided near a rear end of the movable plate 40. The return device 56 includes a handle 562 and a transverse bar 564. The handle 562 is mounted to the top cover shell 32 and exposed outside the top cover shell 32 for convenient pulling by the user. The transverse bar 564 is fastened to the handle 562 and located above the movable member 55. A fifth spring member 58 is provided to push the transverse bar 564 to move toward the movable plate 40. The transverse bar 564 has ten positioning portions 566 corresponding to the positioning members 52, and a longitudinal sliding groove 569 formed on a bottom side thereof. The positioning portions 566 each have a sloping surface 568 matching the sloping surfaces 522 of the positioning members 52 respectively. The protruding portion 558 of the movable member 55 extends into the longitudinal sliding groove 569.

The pin tumbler lock 60 is mounted inside the lock housing 30 and extending out of the lock housing 30 and the base casing 20 through the keyhole 324 of the top cover shell 32 and the second hole 244 of the top cover 24. The pin tumbler lock 60 has a keyway 62 in a top side thereof and a bottom actuation member 64 at a bottom side thereof. The bottom actuating block 64 has a spiral sloping surface 642. The pin tumbler lock 60 can be rotated with the key between the locking position and the unlocking position. When the key is inserted into the keyway 62 and rotated to open the pin tumbler lock 60, the bottom actuating block 64 is synchronously rotated with the key to force the spiral sloping surface 642 against the extension portion 46 of the movable plate 40, thereby moving the movable plate 40 from the first position to the second position (see FIG. 9). When the pin tumbler lock 60 is located at the locking position, the spiral sloping surface 642 of the bottom actuating block 64 is separated from the extension portion 46 of the movable plate 40.

Figure 6:
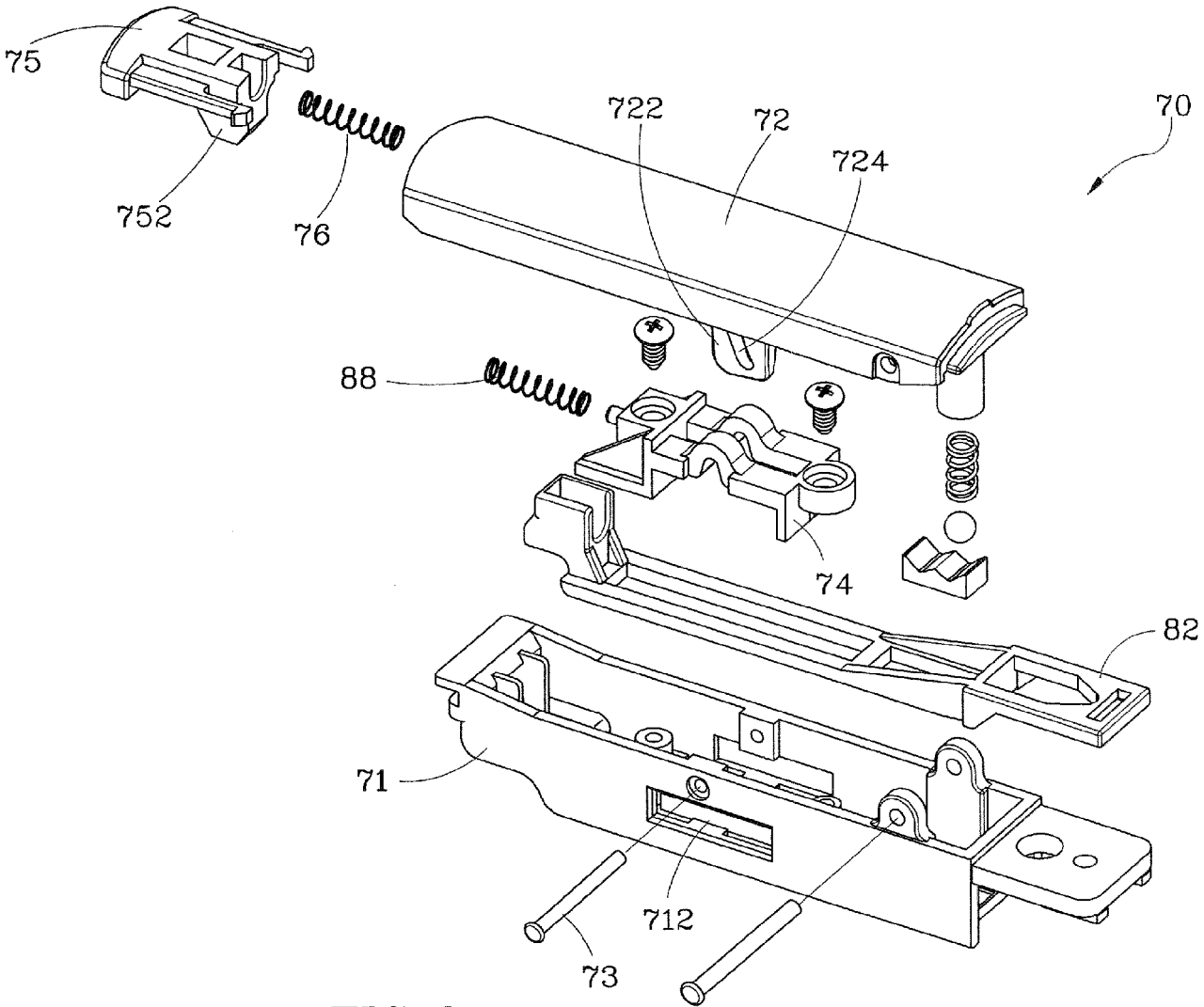
FIG. 6 is an exploded view of one locking unit of the suitcase lock assembly according to the present invention.

Referring to FIG. 6, the locking units 7 each are comprised of a holder frame 71, a locking cover 72, a locating rod 73, and a locating plate 74. The holder frames 71 of the locking units 7 are respectively coupled to two opposite sides of the bottom shell 22 of the base casing 20, each having a retaining hole 712 and a hook hole 714, as shown in FIG. 8. The locking covers 72 each have one end pivoted to the corresponding holder frame 71, a bottom retaining rod 722 downwardly extending from a bottom side thereof, and a smoothly curved sliding slot 724 in the bottom retaining rod 722. Each of the locating rods 73 is inserted through the smoothly curved sliding slot 724. Each of the locating plate 74 is affixed to the bottom side of the locking cover 72. Each of the locking units 7 further includes a push block 75 and a sixth spring member 76. The push blocks 75 each have a push rod 752 hooked in the hook hole 714 of the holder frame 71. Each of the sixth spring members 76 has two ends stopped between the push block 75 and the locking cover 72.

Referring to FIG. 8, the linking units 80 each are comprised of a first link 82, a second link 84, and a third link 86. The first links 82 are disposed inside the holder frames 71 of the locking units 70, each having a rear end stopped against the push rod 752 of the push block 75 and a front end thereof coupled to a rear end of the second links 84. Further, a seventh spring member 88 is connected between each of the first links 82 and each of the locating plates 74 of the locking units 7, as shown in FIG. 6. The second links 84 are disposed inside the accommodation chamber 28 of the base casing 20, each having a front end coupled to a rear end of the third links 86. The third links 86 are disposed inside the accommodation chamber 28 of the base casing 20, each having a front end for being stopped by the stop flange 44 of the movable plate 40. When the locking covers 72 are closed with respect to the holder frames 71, the stop flange 44 of the movable plate 40 stops the front ends of the third links 86. At this time, pushing the push blocks 75 cannot move the third links 86. When the movable plate 40 is located at the second position, the front ends of the third links 86 are not stopped by the stop flange 44 of the movable plate 40, so that the push blocks 75 can be pushed to move the third links 86 and then the locking covers 72 can pivot with respect to the holder frames 71.

Figure 7:
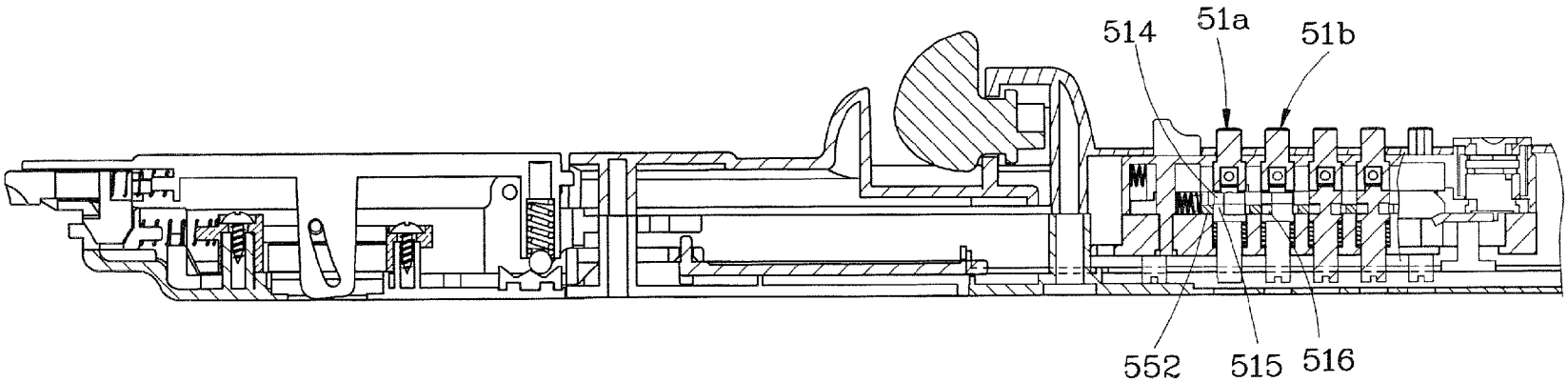
FIG. 7 is a sectional view of a part of the present invention, showing that the push-button lock is locked.

When the suitcase lock assembly 10 is applied in a suitcase, the two hooks of the suitcase can be inserted through the retaining holes 712 of the holder frames 71 of the locking units 7 into the inside of the holder frames 71. When setting one push button 51*a* for the desired combination, the user can insert a hand tool into the tool grooves 518 of the bodies 512 one by one and rotate the bodies 512 for 90 degrees to enable the first grooves 514 of the respective push buttons 51*a* to face the corresponding side wings 552 of the movable member 55 while the second grooves 516 of the other push buttons 51*b* are kept facing the corresponding side wings 552 of the movable member 55. When the push buttons 51*a* and 51*b* are not pressed, as shown in FIG. 7, the side wings 552 of the movable member 55 are stopped by the first stop portions 515 of the push buttons 51*a*, and therefore the movable member 55 is immovable. When the push buttons 51*a* and 51*b* are pressed subject to the set combination, as shown in FIG. 5, the positioning members 52 are forced inwards against the corresponding second spring members 53, and the sloping surfaces 522 of the positioning members 52 are moved along the sloping surfaces 568 of the positioning portions 566 till that the positioning members 52 are completely disengaged from the positioning portions 566 and top ends of the positioning members 52 are respectively stopped at bottom ends of the positioning portions 566, holding the push buttons 51*a* in the pressed position. At the same time, the movable member 55 is pushed by the fourth spring member 57 to engage its one side wing 552 into the first groove 514 of one push button 51*a* and its other side wings 552 into the second grooves 516 of the other push buttons 51*b*, as shown in FIG. 8. At this time, the sloping surface 556 of the front stop end 554 of the movable member 55 is pressed on the extension portion 46 of the movable plate 40 to move the movable plate 40 from the first position to the second position, thereby unlocking the push-button lock 50. The user can thus push the push blocks 75 to move the corresponding first links 82 and then the corresponding second and third links 84 and 86, and to further enable the corresponding locking covers 72 to pivot upward, thereby releasing the push rod 752 of the push blocks 75 from the hook holes 714 the holder frames 71, and therefore the bottom retaining rods 722 of the locking covers 72 are released from the hooks of the suitcase, allowing the user to open the suitcase.

After the suitcase is closed, the user can pull the handle 562 to move the transverse bar 564 away from the movable plate 40. By means of the engagement between the end edge of the longitudinal sliding groove 569 and the protruding portion 558 of the movable member 55, the movable member 55 is carried away from the movable plate 40 by the return device 56. At this time, the positioning portions 566 of the transverse bar 564 are deviated from the positioning members 52, and the side wings 552 of the movable member 55 are disengaged from the first grooves 514 and second grooves 516 of the push buttons 51*a* and 51*b*, and the push buttons 51*a* are pushed backwards to the previous position by the corresponding third spring members 54, and therefore the push-button lock 50 is locked.

If the user presses the wrong push buttons, the side wings 552 of the movable member 55 will be still stopped by the first stop portions 515 of the push buttons 51*a* and prohibited from moving forward, such that the movable plate 40 can not be moved to the second position to open the suitcase.

Figure 9:
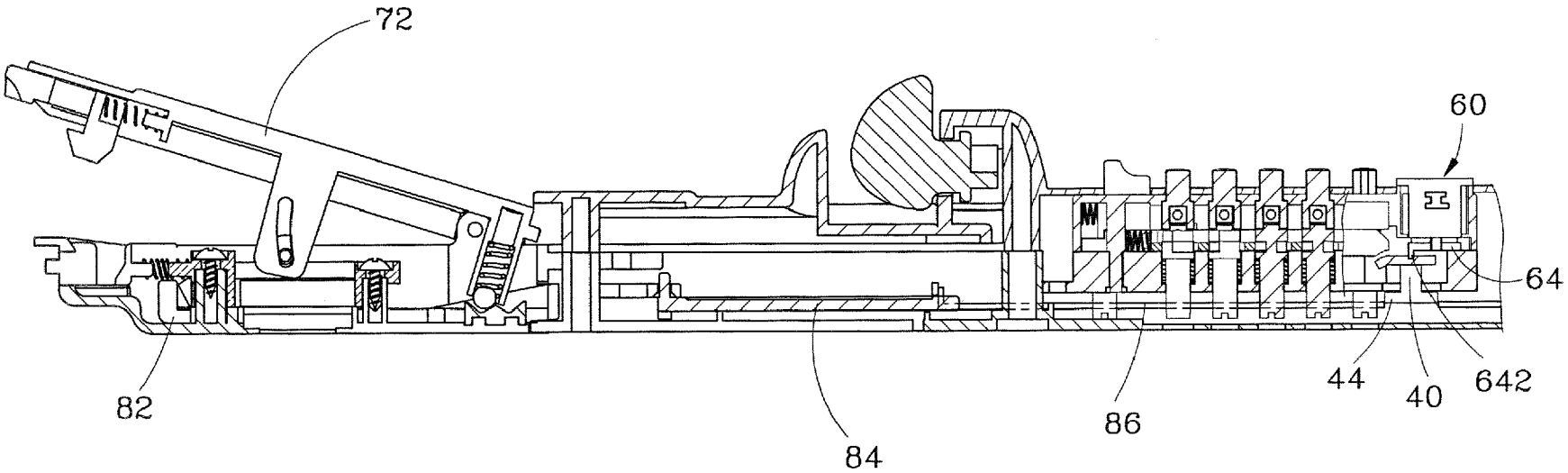
FIG. 9 is a sectional view of a part of the present invention, showing that the pin tumbler lock is unlocked.

Referring to FIG. 9, if the user forgets the correct combination of the push-button lock 50, the user can insert the key into the keyway 62 of the pin tumbler lock 60 and rotate the key to enable the spiral sloping surface 642 of the bottom actuating block 64 of the pin tumbler lock 60 to press against the movable plate 40, forcing the movable plate 40 from the first position to the second position. Thus, the third links 86 are free from the constraint of the stop flange 44 of the movable plate 40, and the user can push the push blocks 75 to drive the corresponding first, second, and third links 82, 84, 86 and to further enable the locking covers 72 to pivot upward, thereby opening the suitcase.

When intending to change the set combination of the push-button lock 50, the user can insert a hand tool into the bottom tool groove 518 of each push button of which the setting is to be changed and then rotate the push button through for 90 degrees to enable the first groove 514 of the push button to face the corresponding side wing 552 of the movable member 55. Thus, the change of the set combination is done.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A suitcase lock assembly comprising:

a base casing;

a lock housing having at least two wells;

a movable plate mounted in said lock housing and movable relative to said lock housing between a first position and a second position;

a push-button lock mounted in said lock housing, said push-button lock comprising at least two push buttons for upward and downward movement in said lock housing, at least two first spring members, a movable member, and a return device, said push buttons each having a first groove and a second groove located below said first groove and alternately arranged, said spring members being sleeved onto said push buttons respectively and mounted in said wells inside said lock housing, said movable member being movable forwards and backwards in said lock housing and having at least two wings and a stop end, a first of said at least two wings being engaged into the first groove of each of at least one of said push buttons and a second of said at least two wings being respectively engaged into the second groove of each of the other push buttons of said push buttons and the stop end of said movable member being stopped against said movable plate when said push-button lock is unlocked, said first and second wings being disengaged from the first and second grooves of said push buttons and said stop end of said movable member being separated from said movable plate when said push-button lock is locked, said return device being movably mounted inside said lock housing and connected to said movable member;

a pin tumbler lock mounted in said lock housing and rotatable between a locking position and an unlocking position, said pin tumbler lock having an actuating block, said actuating block being stopped against said movable plate when said pin tumbler lock is located at said unlocking position, said actuating block being separated from said movable plate when said pin tumbler lock is located at said locking position;

two locking units each having a holder frame mounted in said base casing, a locking cover pivoted to said holder frame, a push block mounted to said locking cover, and a spring member connected between said locking cover and said push block, said locking cover having a retaining rod; and two linking units movably mounted in said base casing and corresponding to said locking units, said linking units each having a spring member, a first link, a second link, and a third link, said spring member being connected between an end of said first link and the holder frame of one of said locking units, said second link having an end coupled to the other opposite end of said first link, said third link having an end coupled to the other opposite end of said second link for stopping against said movable plate;

wherein when said movable plate is located at said first position, the other opposite ends of said third links of said linking units are stopped against said movable plate, said push blocks are prohibited from moving said linking units, and the locking covers of said locking units are prohibited from pivoting movement relative to the corresponding holder frames; when said movable plate is located at said second position, the opposite ends of the third links of said linking units are free from the constraint of said movable plate, said push blocks are movable to drive said linking units to move, and the locking covers of said locking units are pivotable relative to the corresponding holder frames.

2. The suitcase lock assembly as claimed in claim 1, wherein said push buttons each comprise a head and a body, said heads each having a bottom end, said body being rotatably mounted in the corresponding well, said body having a top end stopped against the bottom end of said head, said first and second grooves being located at said bodies of said respective push buttons.

3. The suitcase lock assembly as claimed in claim 2, wherein said push-button lock further comprises a plurality of positioning members and second spring members, said positioning members being mounted in the heads of said push buttons, said second spring members being connected between said positioning members and the heads of said push buttons; said return device comprises at least two positioning portions for stopping against said positioning members when said push buttons are pressed.

4. The suitcase lock assembly as claimed in claim 3, wherein said positioning members each have a sloping surface; the positioning portions of said return device each have a sloping surface respectively abutted against the sloping surfaces of said positioning members.

5. The suitcase lock assembly as claimed in claim 2, wherein the body of each of said push buttons has a tool groove at a bottom end thereof.

6. The suitcase lock assembly as claimed in claim 1, wherein said return device has a longitudinal sliding groove; said movable member has a protruding portion extending into said longitudinal sliding groove of said return device.

7. The suitcase lock assembly as claimed in claim 1, wherein the actuating block of said pin tumbler lock has a sloping surface for pushing against said movable plate when said pin tumbler lock is located at the unlocking position and for separation from said movable plate when said pin tumbler lock is located at the locking position.

* * * * *